United States Patent [19]

Bredin

[11] 4,238,989

[45] Dec. 16, 1980

[54] DEVICE FOR FEEDING CHANNEL FOR AMMUNITION FOR AUTOMATIC GUN

[75] Inventor: Bertil Bredin, Karlskoga, Sweden

[73] Assignee: Aktiebolaget Bofors, Bofors, Sweden

[21] Appl. No.: 952,226

[22] Filed: Oct. 17, 1978

[30] Foreign Application Priority Data

Oct. 26, 1977 [SE] Sweden ..... 7712031

[51] Int. Cl.[3] ..... F41D 10/38

[52] U.S. Cl. ..... 89/33 BB

[58] Field of Search ..... 89/33 BB, 33 E

[56] References Cited

U.S. PATENT DOCUMENTS 2,329,308 9/1943 Trotter et al. ..... 89/33 E

FOREIGN PATENT DOCUMENTS 954896 1/1950 France ..... 89/33 E

*Primary Examiner*—Stephen C. Bently

*Attorney, Agent, or Firm*—Pollock, Vande Sande & Priddy

[57] ABSTRACT

An improved apparatus for feeding ammunition to an automatic gun is disclosed, in which the length of the channel through which ammunition moves from the magazine to the gun may be varied automatically to match the feed rate of the ammunition to the demand rate of the gun.

14 Claims, 7 Drawing Figures

DEVICE FOR FEEDING CHANNEL FOR AMMUNITION FOR AUTOMATIC GUN

BACKGROUND OF THE INVENTION

The present invention relates to a device for an automatic gun, particularly a rapid-fire gun, at which is arranged a magazine and a feeding channel for ammunition extending between the magazine and the gun.

In the beginning and at the end of a burst of fire in an automatic gun, the rounds in the ammunition channel must rapidly be accelerated and retarded, respectively. If the gun then has magazine feed with many rounds in the magazine and the loading channel, there will be difficulties involved in achieving sufficient changes of speed, which are required for optimal rapid fire. The gun in question moreover utilizes an automatic loader, which is known in itself, with which the feed of the rounds in the last feeding steps does not take place at a constant speed, which also counteracts optimal rapid fire.

SUMMARY OF THE INVENTION

The purpose of the present invention is to solve, inter alia, these problems, and in accordance herewith a device functioning as a buffer is proposed, the main characteristics of which can be considered to be that in the feeding channel a unit for varying the length of the channel is provided which for certain cases of the ammunition feed is arranged to lengthen the channel when the infeed to the unit takes place faster than the outfeed from the unit and to shorten the channel when said outfeed is faster than said infeed.

BRIEF DESCRIPTION OF THE DRAWINGS

An embodiment proposed at present of a device which has the characteristics significant for the invention will be described in the following, with reference to the accompanying drawings, in which FIG. 1 in a vertical section shows parts of the new device utilizing the feeding channel for rounds between a magazine not shown and an automatic firearm not shown, FIG. 2 in a vertical section shows the device according to FIG. 1 in a first stage of functioning, FIG. 3 in a vertical section and in principle shows a second functioning stage of the device according to FIG. 1, FIG. 4 in a vertical section and in principle shows a third functioning stage of the device according to FIG. 1, FIG. 5 in a vertical section and in principle shows a fourth functioning stage of the device according to FIG. 1, FIG. 6 in a vertical section and in principle shows a modified embodiment compared with the embodiment according to FIG. 1, and FIG. 7 in a vertical section and in principle shows a driving arrangement for wheels which are comprised in a further modified embodiment of the device compared with the embodiment according to FIG. 6.

DESCRIPTION OF THE PREFERRED EMBODIMENTS

Figure 1:
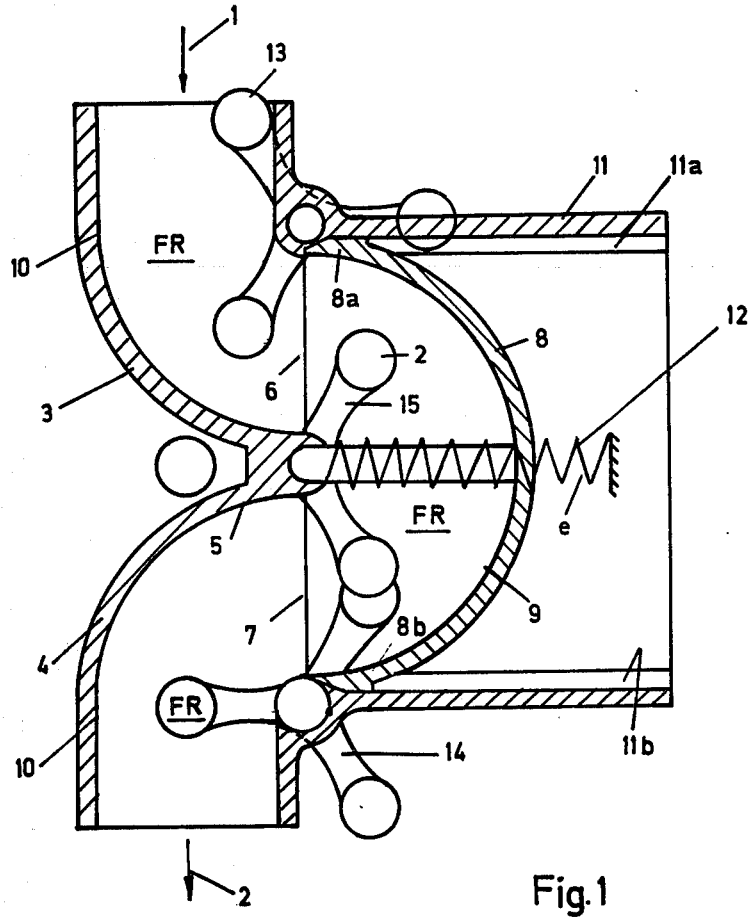

FIG. 1 illustrates parts of a feeding channel FR for an automatic gun not shown, and its magazine, also not shown. Both the gun and the magazine can be of kinds which are known in themselves. The feeding channel FR is shown in a section in which rounds fed into the channel extend at right angles to the plane of FIG. 1. The arrow 1 shows an infeed direction from the magazine and the arrow 2 shows an outfeed direction to the automatic gun in question. The feeding channel has a first curved section 3 and a second curved section 4. Both the first and the second sections are turned 90° and are fastened to the parts 5 facing each other. The first and second sections will in that way have their mouths 6 and 7, respectively, arranged beside each other so that centre lines through the mouths will extend parallel to each other.

At said mouths, a unit for varying the length of the feeding channel is arranged. The unit comprises a guide wall or part 8 extending across the mouths of the first and second sections wall comprises which a semicircular inner surface 9 constituting an extension of the inner wall of the feeding channel FR. The guide wall 8 has substantially the same thickness of material as the first and second curved sections 3 and 4, and is moreover of substantially uniform thickness along the major portion of its extent. At its ends facing mouths 6*a* and 7, guide wall 8 includes a pair of supporting means or tongues 8*a* and 8*b*. The unit for varying the length of the channel also comprises a supporting element 11 which extends in the directions of the centre lines of the mouths 6 and 7. On its inside, the supporting element 11 is provided with longitudinal grooves 11*a* and 11*b*, into which supporting tongues 8*a* and 8*b* extend so that element 11 can be displaced in the direction away from and towards said mouths.

The illustrated supporting tongues 8*a* and 8*b* and guide grooves 11*a* and 11*b* can be considered to represent a plurality of supporting tongues and supporting grooves arranged beside each other in the depth direction of the figure. Also the supporting element 11 has a thickness of material which substantially corresponds to the thickness of material of the first and second curved sections. At guide wall 8 a spring 12 is applied, arranged so that it urges guide wall 8 in the direction towards the mouths 6 and 7.

At or on the first curved section 3 a first star wheel 13 is applied, which is arranged so that it cannot be displaced, but can rotate. Said first star wheel can be considered to represent one or a plurality of first feeding wheels arranged in the depth plane of FIG. 1 which coact with the elongated rounds at several places along their lengths. The first star wheel obtains its drive from the magazine in a way which is known in itself.

At or on the second curved section 4 one or a plurality of second star wheels or feeding wheels 14 are applied, arranged in the corresponding way as said first star wheel 13, with the exception that they instead obtain their drive from the gun, i.e. the first and second star wheels are driven independent of each other.

Further, at the part 8, a third or a plurality of third star or transmission wheels 15 are applied, arranged in the depth direction of the plane of the figure. Each third star wheel is supported freely in the part 8, so that it follows the part 8 in its movements away from and towards said mouths. The movement of the star wheel is substantially linear.

Figure 2:
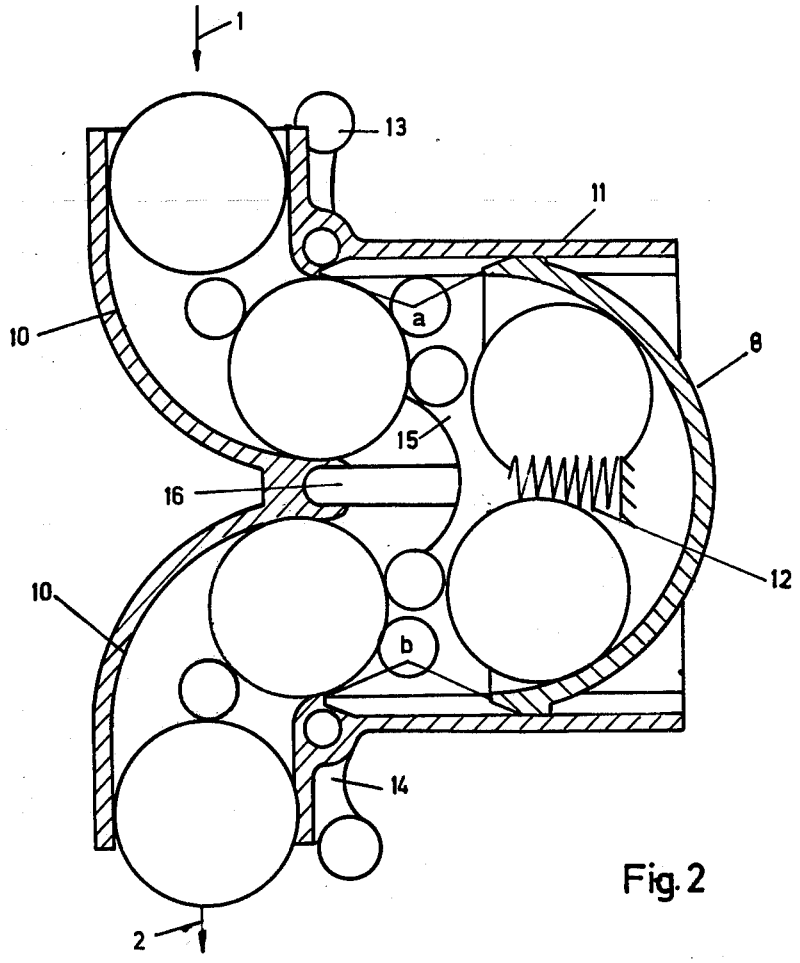

FIG. 2 is intended to show the case when rounds fed from the magazine have caused the part 8 to be displaced from the mouths of the first and second curved sections against the direction of action of the spring 12. In FIG. 2, also the third star wheel 15 has followed along in this movement towards the right. A supporting part for the part 8 and the star wheel 15 has been designated 16 in FIG. 2. An increase of the length of the channel has been obtained through said displacement since sections a and b of the supporting surface of the supporting element 11 for the part 8 now form part of the inner wall 10 of the feeding channel. The length of said sections a and b depends upon the degree of displacement of the part 8, the more the part 8 is displaced from the mouth, the longer the sections a and b and vice versa.

Figure 3:
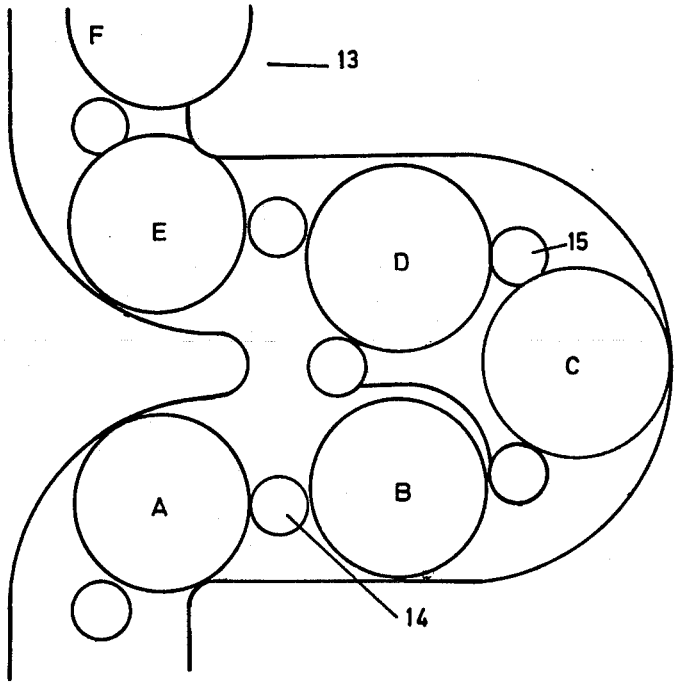
Figure 4:
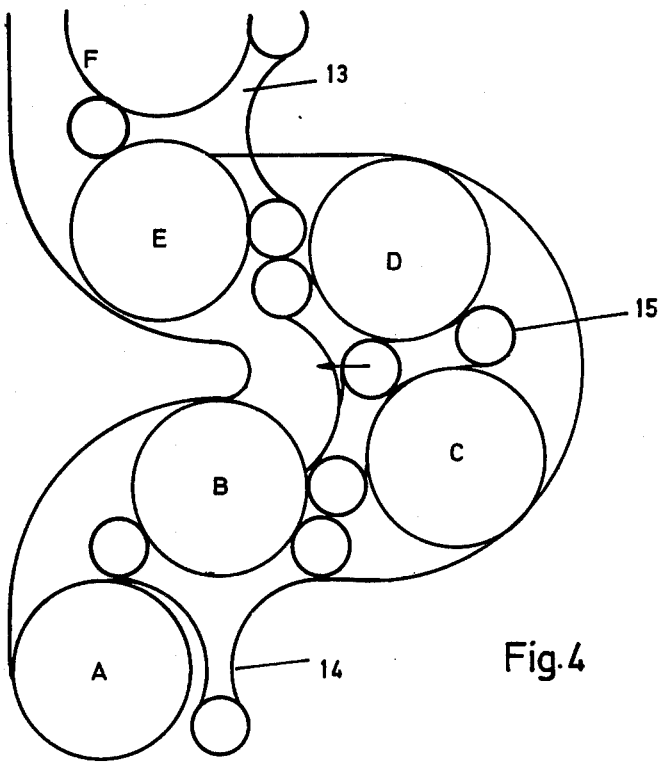
Figure 5:
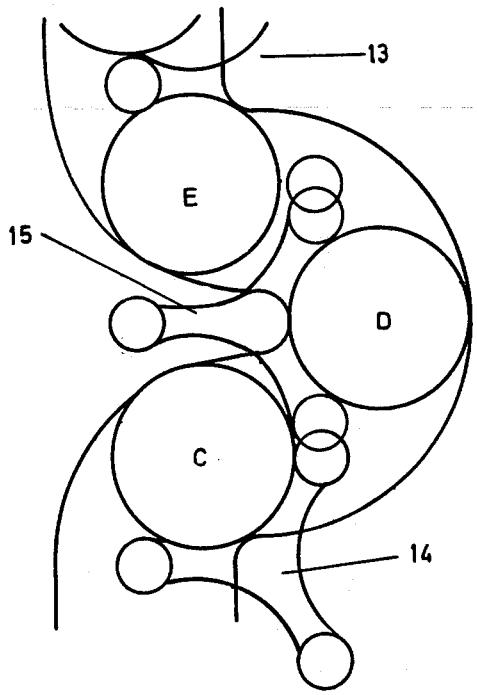

FIGS. 3–5 are intended to show, in principle, various functioning situations of the part 8 and the star wheels 13–15, FIG. 3 then showing the maximum and FIG. 5 the minimum displacement positions of the part 8. In the case according to FIG. 3, the maximum number of rounds has been stored in the unit, and in the case according to FIG. 5, the minimum number of rounds has been stored in the same unit. The rounds in the figures have the designations A, B, C, D, E and F.

The situation according to FIG. 3 is the normal starting position of the buffer device. When firing commences with the automatic gun not shown, the round A is fed down towards the gun by the star wheel 14. The star wheel 15 is then turned, and at the same time its centre is displaced towards the left in the figure, due to the spring force from the spring 12, with the result that the rounds B and C in the unit are fed towards the gun to the positions shown in FIG. 4. This process continues until the infeed from the magazine has started, i.e. until the star wheel 13 begins to move. The movements of the part 8 and the star wheel 15 should appropriately be adapted so that said starting of the infeed begins when the whole of round A has been fed down, and the star wheel 15 then is half way between its end positions for the longitudinal displacement. If no further downfeed takes place, the unit will successively be filled until its starting position according to FIG. 3 is resumed. The part 8 and the star wheel 15 will then be moved towards the right in FIG. 4, at the same time as the wheel 15 is turned clockwise. If the outfeed to the gun takes place faster than the infeed from the magazine, which is possible during the time required for the acceleration of the magazine feed, the unit will be emptied successively. The limit situation which can then be reached is shown in FIG. 5. Normally, however, the magazine feed should be dimensioned in such a way in relation to the gun feed that the limit situation according to FIG. 5 need never be reached.

Figure 6:
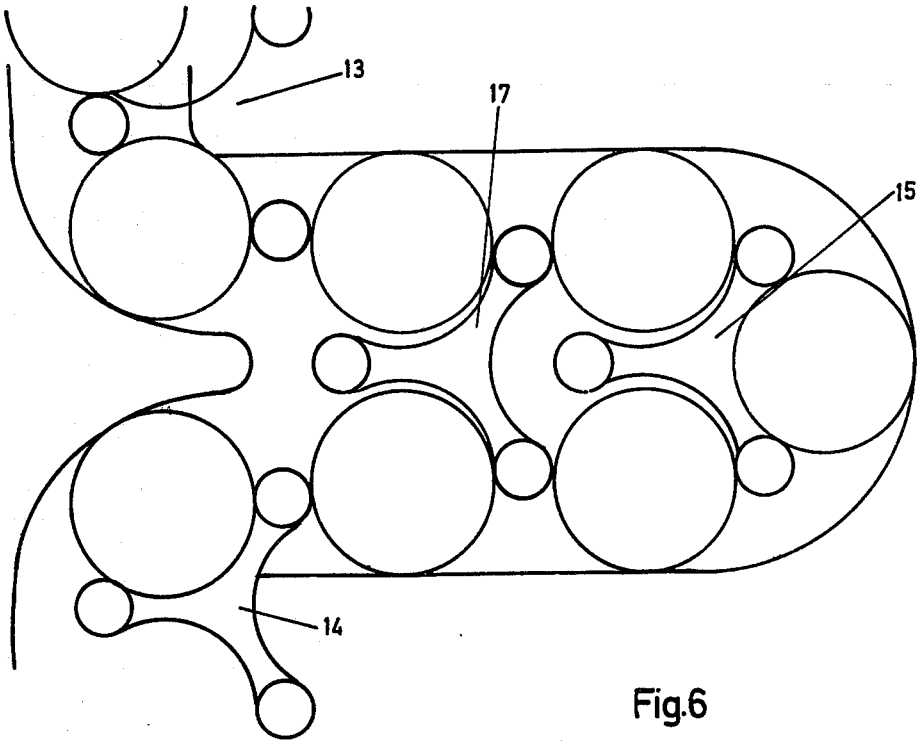

If a greater storage capacity is desired in the buffer unit, this can be achieved by a fourth star wheel 17 being supported in the part 8 in the corresponding way as the star wheel 15, but at a predetermined dividing distance from this. FIG. 6 shows the situation when the part 8 has the maximum displacement from the above-mentioned mouths. Said fourth star wheel 17 is then synchronized with the third star wheel 15, and the synchronization can then be achieved by means of a transmission, not specially shown, between the two star wheels in question. The function with two movable star wheels 15 and 17 will correspond to that with only one movable star wheel 15.

Figure 7:
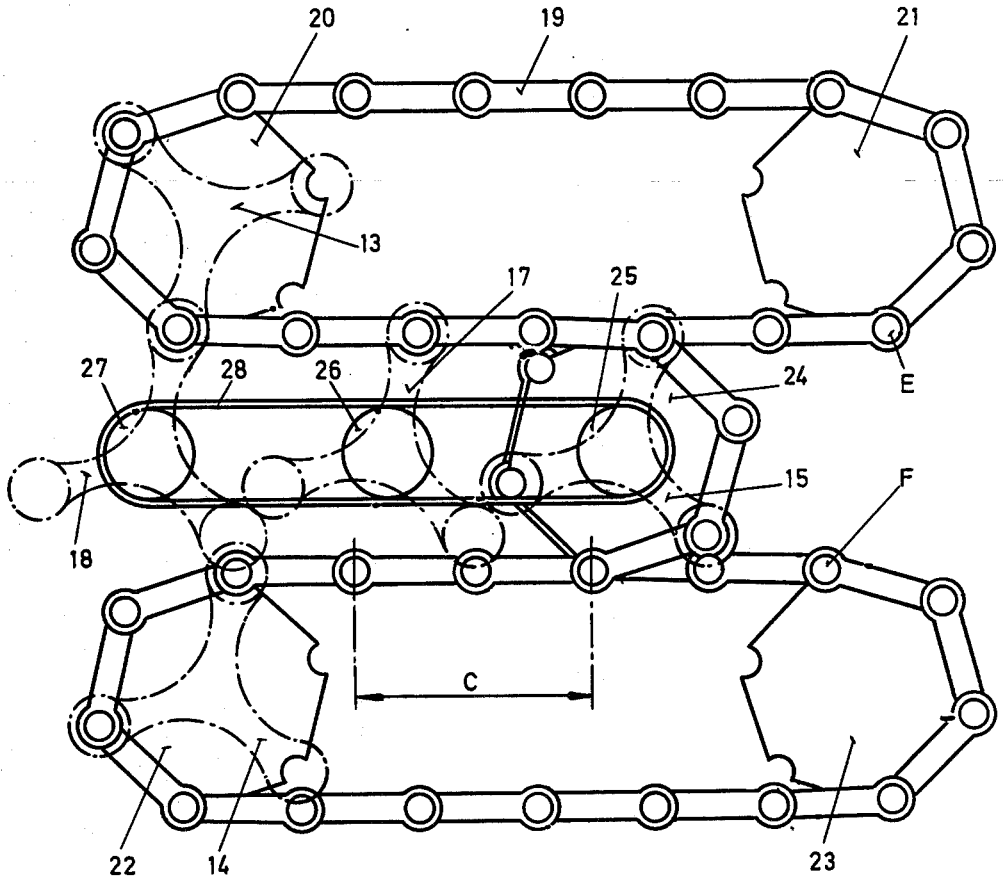

In principle, the unit can be provided with a further star wheel 18, in accordance with FIG. 7, and can then serve as a buffer for a still greater number of rounds. However, because of the friction which arises in the last-mentioned case, some kind of forced drive would have to be resorted to for the movable star wheels 15, 17 and 18. FIG. 7 gives an example of such a forced drive, i.e. during the infeed or outfeed of rounds in the buffer magazine, the star wheels 15, 17 and 18 are to be driven with help from the star wheels 13 and 14.

The forced drive includes an endless chain 19, which is placed on five chain wheels 20–24. The chain wheel 20 is then supported on the same shaft as the star wheel 13, the chain wheel 22 on the same shaft as the star wheel 14, and the chain wheel 24 on the same shaft as the star wheel 15, each respective pair of chain wheels and star wheels then following each others turning movements. Said chain 19 then extends from the chain wheel 20, towards and around the chain wheel 24, and from there on to and around the chain wheel 22 and towards the chain wheel 23 and from the chain wheel 23 towards and around the chain wheel 24, to and around the chain wheel 21 and from there on to the chain wheel 20. The chain wheel 24 is thus arranged so that, in addition to being displaceable to and away from the above-mentioned curved sections together with the star wheels 15, 17 and 18, it can support two half turns of the chain, located beside each other and facing each other.

Said chain 19 comprises links which have a length corresponding to one half of the division "c" between the rounds. Each round which is fed out through the buffer magazine will hereby be followed by a chosen joint point between two links in the chain, so that the position of the joint point with small deviations will correspond to the centre line of the round. The star wheels 15, 17 and 18 will be turned by the chain so that their angular positions always correspond to the positions of the rounds. The degree of displacement of the star wheels to the right in FIG. 7 will in the same way be regulated by the chain, in that the part of the chain which extends from the chain wheel 20, around the chain wheel 24 and to the chain wheel 22 will be changed when rounds are fed in and fed out by the star wheels 13 and 14, respectively. As the chain is endless, the part of the chain which extends from the chain wheel 21, around the chain wheel 24 and to the chain wheel 23 will be reduced or increased to correspond to the increase or reduction, respectively of the first-mentioned part of the chain.

FIG. 7 also shows a synchronization of the movements of the star wheels 15, 17 and 18. Said star wheels 15, 17 and 18 have centre chain wheels 25, 26 and 27, on which a synchronization chain 28 is applied. When the star wheel 15 is turned, also the star wheels 26 and 25 will be turned to the corresponding degree.

The same feeding channel FR for ammunition can be provided with one or a plurality of the units described above and serving as buffers.

The invention is not limited to the embodiment shown above as an example, but can be subject to modifications within the scope of the invention.

I claim:

1. Apparatus for feeding ammunition in an automatic gun of the type having a magazine and a feeding channel extending between the magazine and the gun, said feeding channel having an inner wall, said apparatus comprising:

first and second curved sections provided in said feeding channel, each section having a mouth;

guide wall means extending across said mouths, said guide means comprising a curved inner surface, said inner surface constituting an extension of the inner wall of said feeding channel;

means supporting said guide wall means for permitting said guide wall means to be displaced away from and toward said mouths, said supporting means comprising a supporting surface extending between said mouths and said guide wall means, the length of said supporting surface being dependent upon the degree of displacement of said guide wall means from said mouths.

2. Apparatus according to claim 1, further comprising spring means for urging said guide wall means toward said mouths.

3. Apparatus according to claim 2, wherein there are a plurality of said guide wall means and supporting means.

4. Apparatus according to claim 2, further comprising first and second driven ammunition feeding wheels arranged respectively at said first and second curved sections of said feeding channel; and at least one ammunition transmission wheel rotatably mounted on said guide wall means whereby it follows said guide wall means away from and toward said mouths.

5. Apparatus according to claim 4, wherein there are a plurality of said guide wall means and supporting means.

6. Apparatus according to claim 1, further comprising first and second driven ammunition feeding wheels arranged respectively at said first and second curved sections of said feeding channel; and at least one ammunition transmission wheel rotatably mounted on said guide wall means whereby it follows said guide wall means away from and toward said mouths.

7. Apparatus according to claim 6, wherein there are three or more transmission wheels, further comprising means powered by said feeding wheels for driving said transmission wheels.

8. Apparatus according to claim 7, wherein there are a plurality of said guide wall means and supporting means.

9. Apparatus according to claim 6, wherein there are two transmission wheels, further comprising means for synchronizing their rotation.

10. Apparatus according to claim 9, wherein there are a plurality of said guide wall means and supporting means.

11. Apparatus according to claim 6, wherein said at least one transmission wheel rotates without an external drive.

12. Apparatus according to claim 11, wherein there are a plurality of said guide wall means and supporting means.

13. Apparatus according to claim 6, wherein there are a plurality of said guide wall means and supporting means.

14. Apparatus according to claim 1, wherein there are a plurality of said guide wall means and supporting means.

* * * * *